US007798084B2

(12) United States Patent
Stroj et al.

(10) Patent No.: US 7,798,084 B2
(45) Date of Patent: Sep. 21, 2010

(54) SAIL AND DEVICE FOR ROTATABLY CONNECTING A SAIL BATTEN TO A MAST AND SHAPING A LUFF OF THE SAIL

(75) Inventors: Robert Stroj, Kula, HI (US); David Starbuck, Kula, HI (US)

(73) Assignee: Neil Pryde Limited, Tuen Mun, New Territories (HK)

( * ) Notice: Subject to any disclaimer, the term of this patent is extended or adjusted under 35 U.S.C. 154(b) by 0 days.

(21) Appl. No.: 11/700,292

(22) Filed: Jan. 31, 2007

(65) Prior Publication Data

US 2008/0066666 A1 Mar. 20, 2008

(30) Foreign Application Priority Data

Sep. 15, 2006 (HK) ..... 06110324
Dec. 8, 2006 (HK) ..... 06113535

(51) Int. Cl.
*B63H 9/04* (2006.01)

(52) U.S. Cl. ..... 114/102.12; 114/102.1; 114/102.15; 114/102.22

(58) Field of Classification Search ..... 114/102.1, 114/102.11–102.19, 102.2, 102.21–102.29, 114/104–109, 111–115
See application file for complete search history.

(56) References Cited

U.S. PATENT DOCUMENTS 5,048,440 A * 9/1991 Spanier ..... 114/39.15
5,189,976 A * 3/1993 Cochran et al. ..... 114/39.12
5,275,117 A * 1/1994 Magnan ..... 114/108

FOREIGN PATENT DOCUMENTS

WO WO8504377 * 10/1985

* cited by examiner

*Primary Examiner*—Daniel V Venne
(74) *Attorney, Agent, or Firm*—Jackson Walker, LLP

(57) ABSTRACT

In a battened sailboard sail a sail attachment device is attached to the leading edge of the sail and the sail attachment device is connected to a camber-inducer by a line that is acted on by a batten to evenly distribute the batten tension load between the sail and camber-inducer. The batten is able to move chordwise relative the camber inducer when the sail is rotating about the mast.

19 Claims, 4 Drawing Sheets

SAIL AND DEVICE FOR ROTATABLY CONNECTING A SAIL BATTEN TO A MAST AND SHAPING A LUFF OF THE SAIL

This application claims priority from and incorporates herein by reference Hong Kong Application No. 06110324.0, filed 15 Sep. 2006; and Hong Kong Application No. 06113535.9, filed 8 Dec. 2006.

BACKGROUND OF THE INVENTION

1. Field of the Invention

This patent application relates to sails and to sailboards, commonly known as windsurfers. More particularly the application relates to a device that rotatably connects a sail batten to a mast and provides tension and/or aerodynamic shape to a luff of the sail. Such a device is known in the art as a Camber inducer, or Cam.

In the following description the terms 'Camber inducer' and 'Cam' are interchangeable and refer to such a device that connects a batten and mast and provides tension and/or aerodynamic shape to the luff of a sail.

2. Background Information

Camber inducers (Cams) have been known for some time. Background concerning the need for Cams and their advent can be found in various patent publications including WO 08504377 A1; U.S. Pat. No. 4,686,921; U.S. Pat. No. 4,625,671; and U.S. Pat. No. 5,048,440.

A sail for a sailboard consists of a sail body having a leading edge or luff and a trailing edge or leach, and a luff pocket attached to the sail body by sewing its edges to the sail body at a location back from the leading edge so that a part of the sail body is located within the luff pocket. Battens are carried in chordwise batten pockets on the sail body between the luff and leach to stiffen and help shape the sail for improved aerodynamic efficiency. The battens are tensioned by batten tensioners located at the leach. The sail is mounted to the sailboard by a mast received within the luff pocket. Because the sail goes in both directions its aerodynamic shape must be able to rotate about the mast from a port tack to a starboard tack and visa versa. The battens are connected to the mast by Cams to help induce profile into the sail and set the entry shape of the sail and help control the aerodynamic foil shape.

Current Cams are of either a direct batten driven or sail body driven type. In the batten driven type the batten is received within a pocket between Cam halves at the back of the Cam. As the batten is tensioned it is pushed forward into Cam. This helps tension the luff pocket and gives very good aerodynamic shape to the sail. However, the leading edge of the sail body that lies within the luff pocket is not tensioned. This is a problem because the leading edge of the sail body carries part of the vertical load on the sail which helps maintain the aerodynamic shape of the sail between the battens.

The above problem is overcome by the sail body driven arrangement where the batten tip is captive at the leading edge of the sail body. This is achieved by a batten tip fitting which is attached (by sewing of otherwise) to the leading edge of the sail and located within the back pocket of the Cam. Compression of the batten tensions the sail body from the leading edge to the trailing edge, but does not drive the cam forward against the mast and so does not tension the luff pocket. Instead luff pocket tension is fixed by the dimension of the pocket, Cam and batten tip fitting. Luff pocket tension can be adjusted by shims fitted to the batten tip fitting allowing it to sit further into or out of the Cam pocket. This Cam arrangement tensions the leading edge of the sail body but rotation of the Cam is stiffer and the sail body snaps from one tack to the other more violently. Often the Cam will fail to rotate properly in the tack leaving the luff of the sail backed. The rider must hit or kick any stuck Cams to rotate them through the tack.

Accordingly, is an object of the present invention to provide a sail for a sailboard, and a device for rotatably connecting a batten to a mast and shaping a luff of a sail, which overcomes or substantially ameliorates the above problems.

SUMMARY OF THE INVENTION

In view of the forgoing, according to a first aspect of the invention there is disclosed herein a battened sail in which the sail has a sail attachment device attached to its leading edge and wherein the sail attachment device is connected to the camber-inducer by a line that is acted on by a batten to evenly distribute the batten tension load between the sail and camber-inducer. More particularly the sail is for a sailboard and comprises a sail body having a luff and a leach, a luff pocket attached to the sail body for receiving a sailboard mast, a batten carried on the sail body between the luff and leach and having a batten tip extending forward of the luff within the luff pocket, a batten tensioner located on the sail for applying tension to the batten, a cam body located in the luff pocket for rotateably engaging the batten with a sailboard mast, and a connector for coupling the cam body, the batten and the sail body together such that batten tension is shared between the cam body and sail.

Preferably, the batten moves chordwise relative to the cam body when the sail is rigged to a sailboard mast and moves to either a port or starboard tack.

Preferably, connector comprises one of a line, a leash or a strap having a first end, a second end and a centre between the first and second ends, and wherein the first end is connected to the cam body, the second end is connected to the sail body and the centre is connected to the batten tip.

Preferably, the sail further includes a sail attachment device attached to the luff of the sail body and movably located with the batten and cam body and wherein the second end of the connector is attached to the sail attachment device.

Preferably, the sail attachment device has a tunnel for slideably receiving the batten through the sail attachment device.

Preferably, the sail further includes a batten tip fitting attached to the batten tip and having an attachment point for movably connecting the batten tip with the centre of the connector.

According to a second aspect of the invention there is disclosed herein a device for coupling a sail batten to a mast in a board sail, the device comprising a body having a first end for rotateably bearing against a mast and a second end for receiving a batten tip, a sail attachment device for attachment to the sail, the sail attachment device movably locatable with the batten and body, and a connector for movably coupling the body, the batten tip and the sail attachment device together such that the batten can move chordwise relative to the body when the sail is rigged to a mast and moves to either a port or starboard tack.

Preferably, the connector shares tension in the batten between the sail and body.

Preferably, the connector has a first end, a second end and a centre between the first and second ends, and wherein the first end is connected to the body, the second end is connected to the sail attachment device and the centre is connected to the batten tip.

Preferably, the first end of the connector is fixedly attached to the device body.

Preferably, the second end of the connector is fixedly attached to the sail attachment device.

Preferably, the centre of the connector is movably connected with the batten tip.

Preferably, the device further includes a batten tip fitting for attachment to the batten tip, the batten tip fitting having an attachment point for movable connection With the centre of the connector.

Preferably, the connector is one of a line, and leash or a strap.

Preferably, the sail attachment device has a tunnel for slideably receiving a sail batten through the sail attachment device.

Preferably, the sail attachment device is slideably located with the second end of the body.

Preferably, the body comprises first and second complimentary body halves located opposite each other and tapered towards the second end, and the sail attachment device and batten tip are received between the complimentary body halves.

Preferably, the body includes a plurality of rollers in peripheral contact with the mast for rolling about the mast when the sail moves to either a port or starboard tack.

In accordance with a second aspect of the invention there is also disclosed herein a device coupling a sail batten to a mast in a board sail and for shaping at least a luff of a sail in which the device and a batten are under tension to give an aerodynamic shape to the sail wherein the device comprises a body having a first end for rotateably bearing against a mast and a second end for receiving the tip of a batten under tension, and a connector for movably coupling the body, the batten and the sail together such that as the body and batten rotate about the mast tension loads of the batten are shared between the body and sail and the batten moves chordwise relative to the body. The device may also comprise a body having a first end for rotateably bearing against the mast and a second end for receiving a batten tip, and one of a leash or line or a strap having a first end connected to the sail and a second end connected to the body and a centre engaging with the batten tip for supporting the tip when the batten is under tension, such that the leash or line or strap distributes the batten tension between the sail and the body and allows the batten to move relative the body as the sail rotates about the mast.

Further disclosure and aspects of the invention are provided in and will become apparent from the following description.

BRIEF DESCRIPTION OF THE DRAWINGS

An exemplary form of the present invention will now be described by way of example only and with reference to the accompanying drawings, in which.

DESCRIPTION OF THE EXEMPLARY EMBODIMENTS

Figure 1:
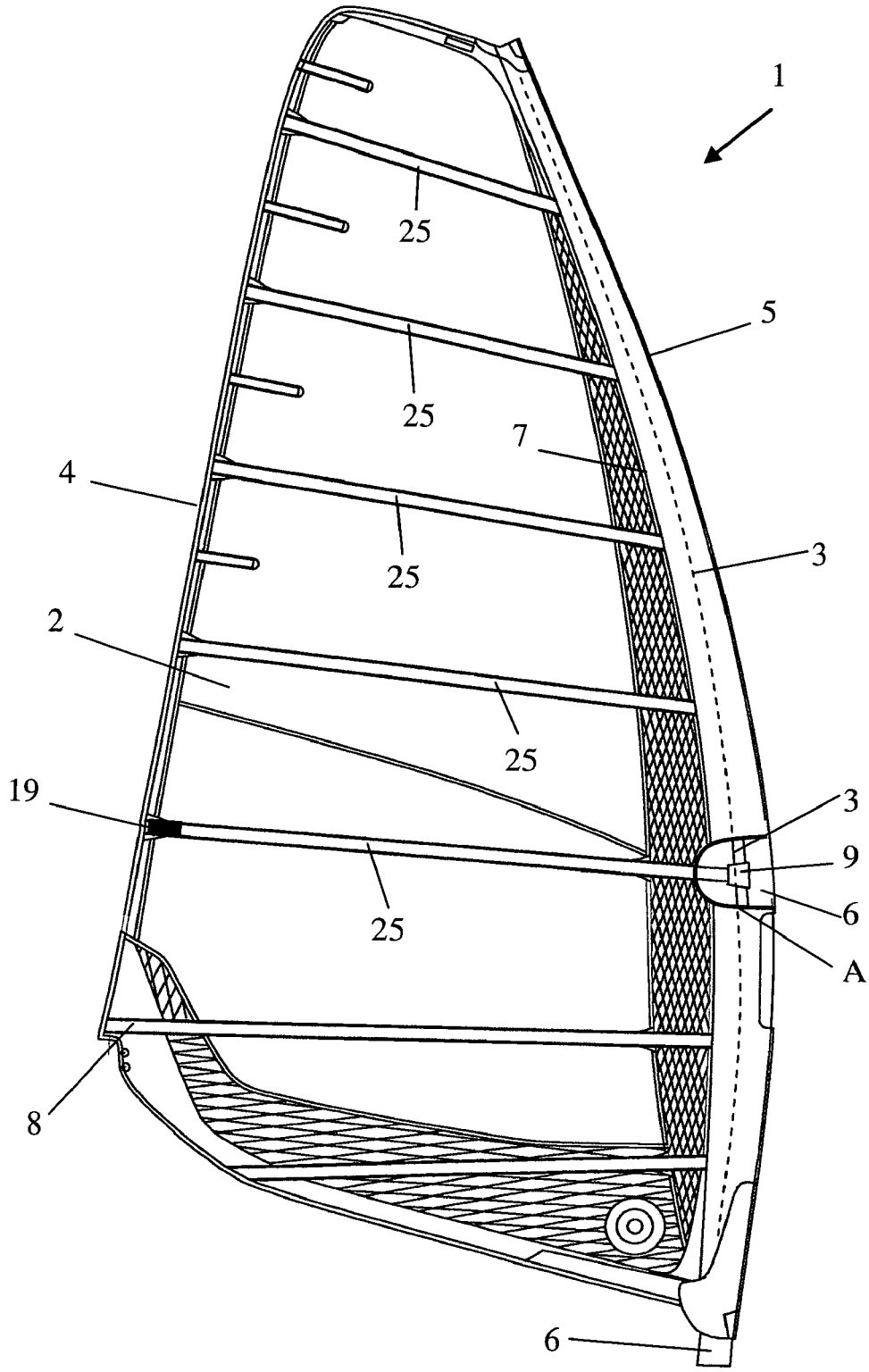
FIG. 1 is a schematic illustration of a sail for a sailboard.

In the various drawings similar elements are identified by the same reference numerals.

Referring to FIG. 1, a sailboard sail 1 comprises a sail body 2 with a leading or luff edge 3, a trailing or leach edge 4 and a luff pocket 5 for connecting the sail to a mast 6. The luff pocket has edges 7 that are sewn to the sail body 2 inwards of the luff edge 3. To rig the sail 1 the mast 6 is received within the luff pocket 5. The sail is stiffened and shaped by a plurality of chordwise battens 8 that extend between the luff 3 and leach 4 of the sail body 2. The battens 8 are carried on the sail body 2 in batten pockets as is known in the art. The batten tips 14 extend forward of the luff edge 3 within the batten pockets 25. The trailing edge of each batten 8 is connected to the sail body 2 by a suitable tensioning device 19 as is also known on the art. Sail shape and chamber can be set by the rider by adjusting the tensioning device to increase or decrease compression forces on each batten. A Camber inducer (Cam) 9 is located between some of the battens 8 and mast 6 for rotateably coupling the batten 8 to the mast and aerodynamically shaping the luff pocket 5 and at least the entry part of the sail body 2 adjacent the luff pocket. In FIG. 1 a section A of the luff pocket 5 is shown cutaway to illustrate a Cam 9 and mast 6 within luff pocket 5.

Figure 2:
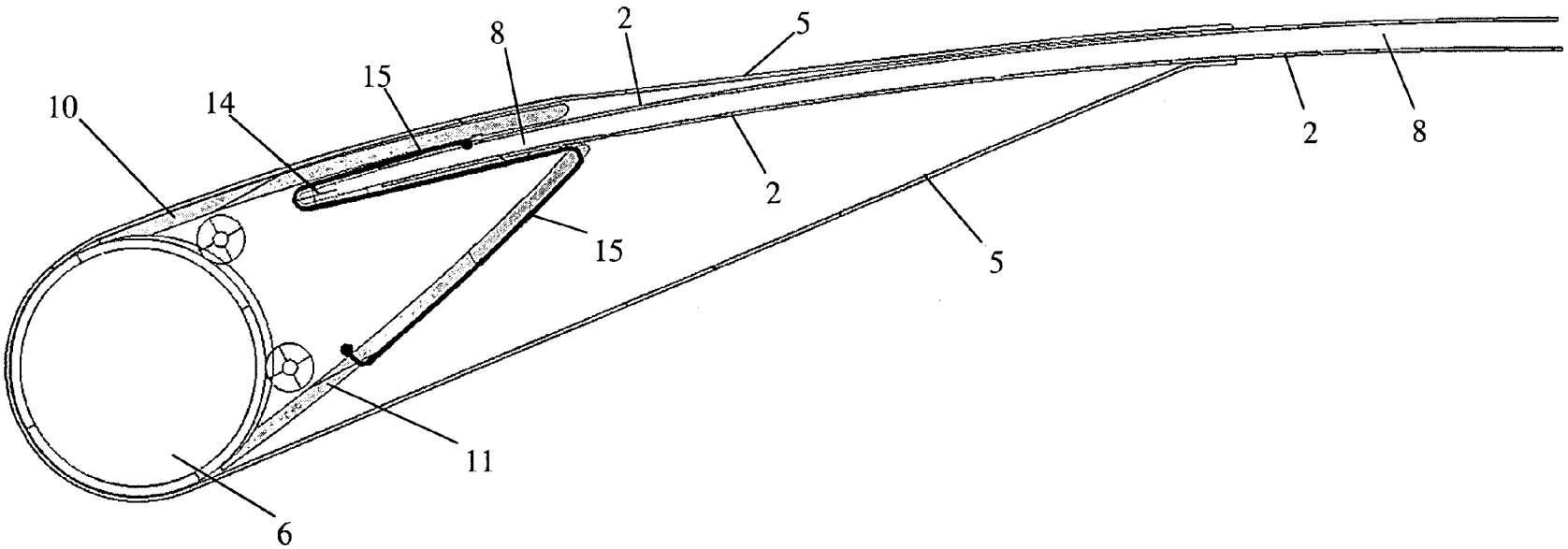
FIG. 2 is a schematic illustration of the sail having a device for rotatably connecting a batten to a mast in accordance with the invention.
Figure 3:
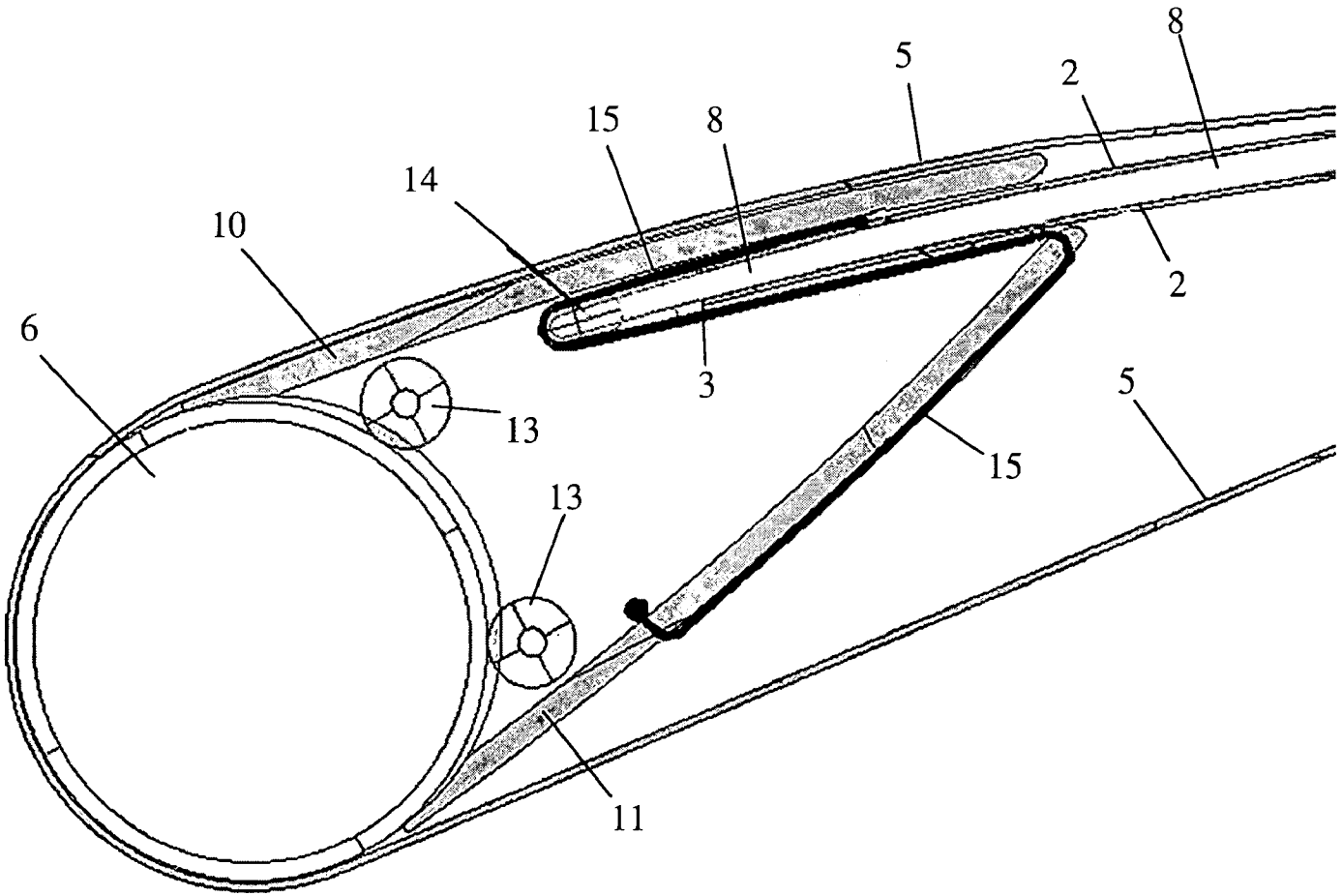
FIG. 3 is a second schematic illustration showing an enlargement of the mast and device of FIG. 1.

FIGS. 2 and 3 illustrate schematically the simplest form of a Cam 9 according to the present invention. The Cam body 9 comprises a pair of complimentary body halves 10, 11 located opposite each other and tapered from a first end at the mast 6 toward a second end at the batten 8. The tapered shape of the Cam 9 helps provide an aerodynamic wing profile in the luff pocket 5 and a smooth aerodynamic transition from the luff pocket 5 into the sail body 2 when the sail is set to port or starboard. The first (mast) end of the Cam 9 has a cage 12 holding a plurality of rollers 13 in peripheral contact with the mast 6 for rolling about the mast when the sail 1 moves to either a port or starboard tack. The luff end batten tip 14 is received between the Cam body halves 10, 11 at the narrow (distal) end away from the mast 6 to locate within the Cam 9. This narrow end enclosing the batten provides a supported pivoting point around which the camber rotates during transitions.

A connector, which in the preferred embodiment is a line 15, movably couples the Cam 11, the batten tip 14 and the sail body 2 together supporting the batten tip 14 chordwise within the Cam 9. The first end of the line 15 is fixedly attached to the sail body 2 adjacent the batten pocket. The line 15 runs chordwise long the batten 8 and engages around the end of the batten tip 14, but is not fixedly attached thereto, and back along the opposite side of the batten 8 towards the distilled end of the Cam body 11. The second end of the line 15 is attached to the Cam body 11. In FIGS. 2 and 3 the leash pass through a hole in one of the Cam bodies 11 and runs back along the Cam body to an external securing point on the Cam body 11. Although not necessary to the invention, the external securing point of the line 5 could be made adjustable for tuning the Cam 9 and batten 8 connection.

By fixing the connector line 15 at either end to the sail and Cam respectively and movably connecting the batten tip 14 to the centre of the line 15 the batten 8 and sail can move in a chordwise direction relative to the Cam 9 when the sail is rotating about the mast between a port and starboard tack or visa versa. The line 15 also distributes tension/compression loads on the batten 8 evenly between the sail body 2 and the Cam 9. Thus, as the sail rotates in the tack elasticity of the sail body and batten pocket allows the batten can move away from the mast, unloading the Cam and letting the Cam move around the mast unhindered.

Figure 4:
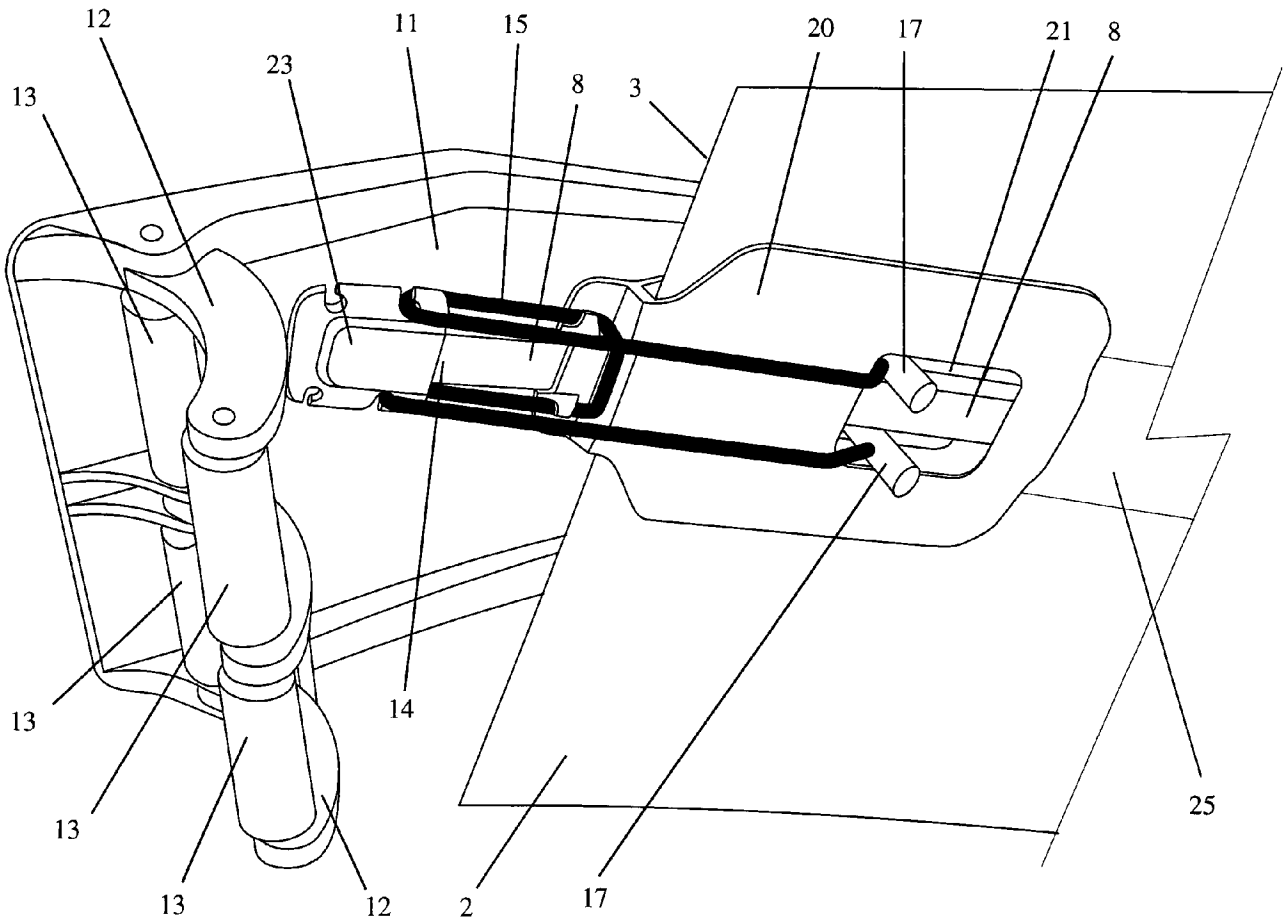
FIG. 4 is a cutaway schematic illustration of a second embodiment of a device for rotatably connecting a batten to a mast in accordance with the invention.

FIG. 4 attached hereto is a schematic illustration of second example of a Cam 9 according to the invention. The Cam body 9 comprises a pair of complimentary body halves 10, 11 located opposite each other and tapered from a first end at the mast 6 to a second end at the batten 8. The distal ends of the complimentary body halves 10, 11 are held spaced-apart by a pair of Cam legs 17 fixed to the body halves 10, 11.

A sail attachment device 20 is sewn onto the luff edge 3 of the sail body 2. The sail attachment device 20 has a tunnel running along its longitudinal axis which is aligned with the batten pocket of the sail. The batten 8 extends from the batten pocket and is slideably received through the tunnel in the sail attachment device 20. The luff edge 3 of the sail body 2 and sail attachment device 20 are located between the complimentary body halves 10, 11 at the distal end of the Cam 9. A transverse opening 21 is provided in the sail attachment device through which the Cam legs 17 extend, slideably engaging the sail attachment device 20 with the Cam 9. There is an attachment point 22 on the sail attachment device 20 for slidable connection of the line 15 to the sail attachment device 20 which is attached to the sail body 2. A batten tip fitting 23 is provided on the batten tip 14 and has several pairs of eyelets 24 for slideably connecting the line 15 to the batten tip 14.

The connector line 15 is closed in a loop. The first end of the loop is connected to the Cam legs 17, fixing it to the Cam 9. The parallel lines of the loop extend along the batten and connected through eyelets 24 of the batten tip fitting 23. The second end of the loop 15 is attached to the attachment point 22 of the sail attachment device 20 fixing it to the sail body 2. The loop of line 15 is fixed at respective ends to the sail body 2 and Cam 9 and is movably connected to the batten tip 14 to its centre. This allows the batten 8 and sail body 2 to move in chordwise directions relative to the Cam 9 when the sail is rotating about the mast between a port and starboard tack or visa versa. The loop 15 also allows the tension/compression loads on the batten 8 to be shared evenly between the sail and the Cam 9. Thus, as the sail rotates in a tack the batten can move away from the mast, unloading the Cam and letting the Cam move around the mast unhindered.

The applicant believes that the device disclosed herein has a number of advantages over Camber inducers currently known in the art. Possible advantages include that batten compression loads are shared evenly between the sail and the Cam and the batten is able to move chordwise relative to the Cam during rotation of the sail thus rotation of the Cam is smoother making tacking and other manoeuvres easier and more comfortable. Another advantage is that rigging and tuning the sail is easier and faster because the rider only needs to tension the battens until the batten pockets and luff pocket are smooth. There is no need to separately tension the battens and Camber inducer.

It should be appreciated that modifications and/or alterations obvious to those skilled in the art are not considered to be beyond the scope of the present invention. For example, in the described embodiment the connector between the sail, batten and Cam is a line. In alternative embodiments it may be a line, a leash or a strap. More rigid connectors are also within the scope of the invention. It is envisioned that a rigid or semi-rigid linkage may be used between the sail attachment device and Cam which is driven by pressure of the batten.

While the systems and methods of this invention have been described in terms of preferred embodiments, it will be apparent to those of skill in the art that variations may be applied to the systems, methods, and in the steps or in the sequence of steps of the method described herein without departing from the concept, spirit and scope of the invention. More specifically, it will be apparent that certain materials that are both functionally and mechanically related might be substituted for the materials described herein while the same or similar results would be achieved. All such similar substitutes and modifications to those skilled in the art are deemed to be within the spirit, scope and concept of the invention as defined by the appended claims.

What is claimed is:

1. A sail for a sailboard, comprising, a sail body having a luff and a leach, a luff pocket attached to the sail body for receiving, in use, a sailboard mast, a batten pocket on the sail body between the luff and the leach and having an opening adjacent the luff and into the luff pocket, a batten carried in the batten pocket and having a batten tip adjacent the sail luff and trailing edge adjacent the sail leach, the batten tip extending through the batten pocket opening within the luff pocket, a batten tensioner located on the sail leach for applying tension to the trailing edge of the batten, a cam body located in the luff pocket for rotateably engaging the batten with a sailboard mast, and a connector comprising one of a line, a leach or a strap having a first end, a second end and a center portion between the first and second ends, and wherein the first end is attached to the cam body, the second end is attached to the sail body and the batten tip engages the center portion.

2. The sail of claim 1 wherein the batten moves chordwise relative to the cam body when the sail is rigged to a sailboard mast and moves to either a port or starboard tack.

3. The sail of claim 1 further including a sail attachment device attached to the luff of the sail body and slideably located with the batten and cam body and wherein the second end of the connector is attached to the sail attachment device.

4. The sail of claim 3 wherein the sail attachment device has a tunnel for slideably receiving the batten through the sail attachment device.

5. The sail of claim 1 further including a batten tip fitting attached to the batten tip and having an attachment point for movably engaging the batten tip with the connector.

6. A device for coupling a sail batten to a mast in a board sail, the device comprising:

a cam body having a first end for rotateably bearing against a mast and a second end for receiving a batten tip, sail attachment device for attachment to the sail, the sail attachment device movably locatable with the batten and cam body, and a connector having a first end, a second end and a center portion between the first and second ends, and wherein the first end is attached to the cam body, the second end is attached to the sail attachment device and the batten tip bearing against the center portion.

7. The device of claim 6 wherein the connector shares tension load of the batten between the sail attachment device and the cam body.

8. The device of claim 6 wherein the first end of the connector is fixedly attached to the cam body.

9. The device of claim 6 wherein the second end of the connector is fixedly attached to the sail attachment device.

10. The device of claim 6 wherein the centre of the connector is movably engaged with the batten tip.

11. The device of claim 10 further including a batten tip fitting for attachment to the batten tip, the batten tip fitting having an attachment point for movable engagement with the center portion of the connector.

12. The device of clam 6 wherein the connector is one of a line, and leash or a strap.

13. The device of claim 6 wherein the sail attachment device has a tunnel for slideably receiving a sail batten through the sail attachment device.

14. The device of claim 6 wherein the sail attachment device is slideably located with the second end of the cam body.

15. The device of claim 6 wherein the cam body comprises first and second complimentary body halves located opposite each other and tapered towards the second end, and the sail attachment device and batten tip are received between the complimentary body halves.

16. The device of claim 15 wherein the cam body includes a plurality of rollers in peripheral contact with the mast for rolling about the mast when the sail moves to either a port or starboard tack.

17. A device for shaping at least a luff of a sail in which the device and a batten are under tension to give an aerodynamic shape to the sail, the device comprising:

a cam body having a first end for rotateably bearing against a mast and a second end for receiving the tip of a batten under tension, and a connector comprising one of a leach, a line or a strap having a first end, a second end and a center portion between the first and second end, and wherein the first end is attached to the cam body, the second end is attached to the sail and the tip of a batten movably engages the center portion, such that as the cam body and batten rotate about the mast tension loads of the batten are shared between the cam body and sail and the batten moves chordwise relative to the cam body.

18. The device of claim 17 further comprising a batten tip fitting for attachment to the batten tip, the batten tip fitting having an attachment point for movable engagement connection with the center of the connector.

19. The device of claim 17 further comprising a sail attachment device for attachment to the sail, the sail attachment device having a tunnel for slideably receiving the batten through the sail attachment device, and being slideably engaged with the second end of the cam body.

* * * * *